US005553738A

United States Patent [19]

Roselli

[11] Patent Number: 5,553,738

[45] Date of Patent: Sep. 10, 1996

[54] AUTOMATIC VENDING MACHINE FOR NEWSPAPERS, MAGAZINES AND THE LIKE

[75] Inventor: Pietro Roselli, Cogozzo, Italy

[73] Assignee: Officine Meccaniche Roselli S.R.L., Cogozzo, Italy

[21] Appl. No.: 459,695

[22] Filed: Jun. 2, 1995

[30] Foreign Application Priority Data

Jun. 3, 1994 [IT] Italy ..... BS94A0060

[51] Int. Cl.[6] ..... B65H 3/00

[52] U.S. Cl. ..... 221/195; 221/231

[58] Field of Search ..... 221/191, 194, 221/195, 226, 231, 277, 279, 258, 262, 236, 237

[56] References Cited

U.S. PATENT DOCUMENTS

| | | | |
|---|---|---|---|
| 3,269,595 | 8/1966 | Krakauer et al. | 221/195 |
| 3,416,705 | 12/1968 | Hohmann | 221/231 |
| 5,400,919 | 3/1995 | Gomm et al. | 221/231 |

*Primary Examiner*—Kenneth Noland

*Attorney, Agent, or Firm*—McGlew and Tuttle, P.C.

[57] ABSTRACT

This invention refers to an automatic vending machine for newspapers, magazines and the like, which is comprised of a casing (11) with a pick-up opening (14) in the bottom base, a carriage (18), sliding along two guide bars (17), driven by a screw-split nut coupling for progressive feed of newspapers up to the pick-up opening. For dispensing one newspaper at a time, a cam (26) is provided which couples and rotates with said screw (21).

10 Claims, 2 Drawing Sheets

AUTOMATIC VENDING MACHINE FOR NEWSPAPERS, MAGAZINES AND THE LIKE

This invention refers in general to appliances for vending newspapers, magazines and the like automatically after insertion into the relevant slot of the corresponding amount in banknotes and/or coins, and in particular it refers to a dispensing mechanism for these types of appliance.

Various forms and executions of automatic newspaper vending machine are already known, for example under patents J. S. N.5.137.134, 5.067.605, 4.935.556, FR n. 2.127.319 and GB n. 1286.847. These known executions encompass the most diversified means of dispensing newspapers, but they invariably present the disadvantages of being complex, unreliable during operation, cumbersome and very expensive.

The aim of this invention is to provide an automatic vending machine for newspapers or the like, which is particularly simple to use and lightweight, does not occupy excessive space, and is perfectly reliable. It should also be compatible with other similar dispensers in one single supporting column so that it is possible to obtain more than one dispensing point in a limited space having easy access.

A further aim of this invention is to provide an automatic vending machine for newspapers and the like with a simple functional built-in dispensing mechanism that is designed to progressively convey and feed numerous newspapers placed sideways and dispense them properly one by one when a signal is sent by the prepayment unit.

A further aim of this invention is to provide an automatic seller able to hold and dispense simultaneously items other than newspapers and magazines, such as socks, records, cassettes, and other similar items, for a wider application of the appliance.

These aims are achieved when you use an automatic vending machine with a dispensing mechanism that has the characteristics listed below. The mechanism is surrounded by a casing which deeper than it is high or wide, and has a money-slot to receive both coins and banknotes. The dispensing mechanism is made up of:

- a support resting on the internal base of the casing which in turn supports a pair of parallel guide bars;
- a sliding carriage that moves along the guide bars from the back of the vending machine to the front carrying the newspapers and magazines placed sideways;
- a rotating screw arranged parallel to the guide bars controlled by an electric gearmotor;
- at least one split nut on board of the sliding carriage which interacts with the rotating screw to; move the carriage from the back to the front of the vending machine;
- a coupled expulsion cam which rotates with said screw to receive from time to time a copy of newspaper from among the stack of newspapers conveyed with the carriage and move it towards an outlet chute to the pick-up opening; the gearmotor controlling said screw and the coupled expulsion cam being activated upon receipt of an authorization signal from the prepayment slot and stopped after the copy of newspaper has dropped onto the pick-up opening and, on the arrival of the next copy of newspaper on the expulsion cam, to the expulsion cam and/or delivery chute, there being associated switching means for opening the electric circuit on the motor to stop the carriage after expulsion of any copy of newspaper.

Further details of this invention will become more evident from the description made with reference to the diagrams here attached, in which.

Figure 1:
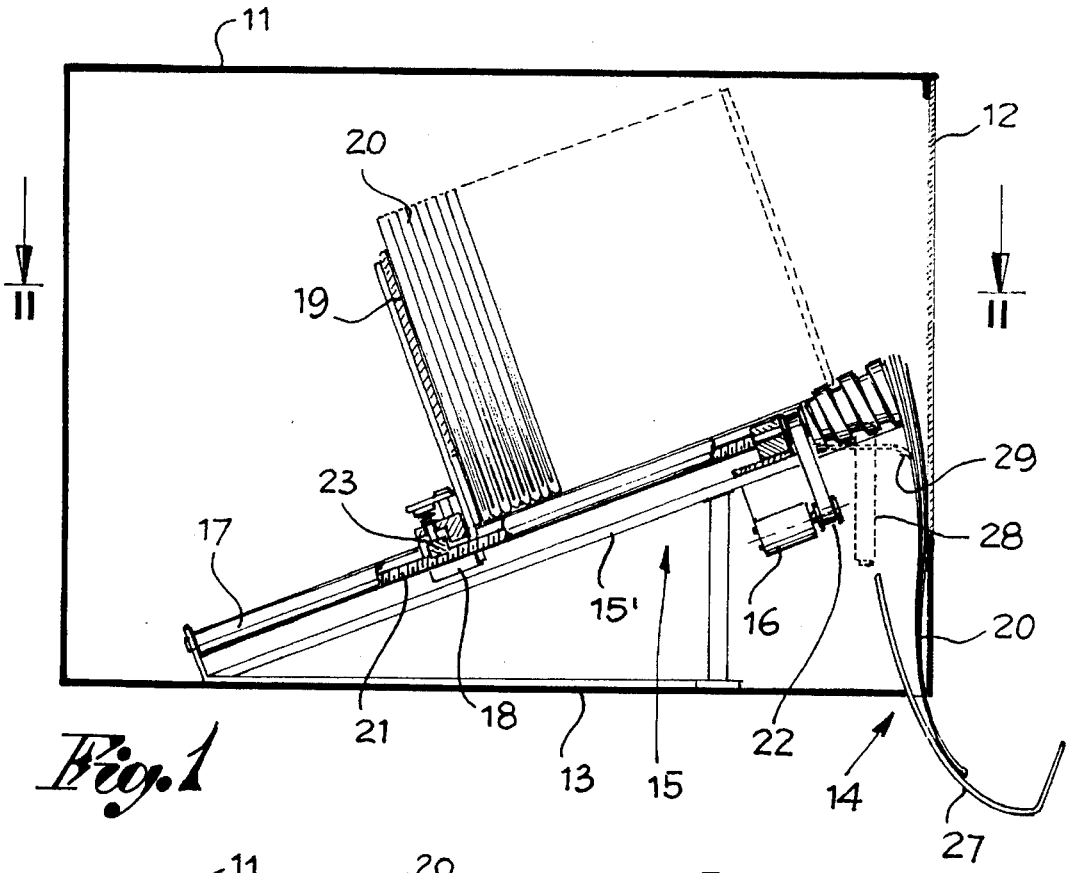
FIG. 1 shows a vertical-longitudinal view of the vending machine.
Figure 2:
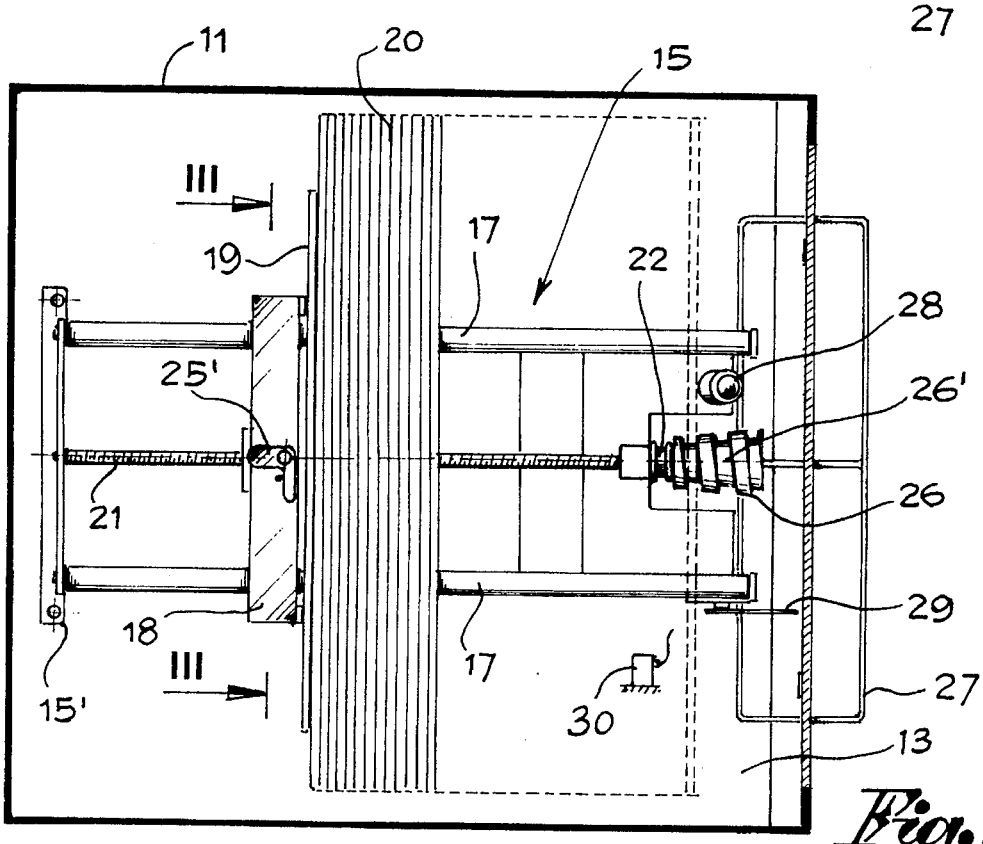
FIG. 2 is a side view according to the arrows II—II shown in FIG. 1.

The vending machine is comprised of a housing or casing 11 in the shape of a parallelepiped, at least with a door 12 at the front, a bottom base 13 and a pick-up opening 14 in the bottom base, adjacent to the front side. The casing 11 contains a dispensing mechanism 15 which is driven by an electric gearmotor 16 running on either mains electricity or battery by means of photovoltaic cells.

Operation of the dispensing mechanism 15 is controlled by a money-slot, not represented - situated in the casing 11.

The dispensing mechanism 15 is comprised of a support 15', resting on the bottom base 13 of the casing 11 and bearing a pair of parallel guide bars 17. The support 15' is designed to support and hold the guide bars 17 inclined upwards, starting from the back of the casing up to the front pick-up opening 14.

The inclination of the guide bars 17 may vary according to the dimensions and the consistency of the items to be dispensed.

A sliding carriage 18 is mounted on the guide bars 17 from the back of the machine to the front. The sliding carriage 18 has a thrust plate 19 against which rests the item to be dispensed, in the specific case, a stack of newspapers 20 arranged sideways on the guide bar 17, as shown in FIG. 1. To the movement of the carriage 18 from the back to the front corresponds a progressive advance of the newspapers 20 to the dispensing area.

Figure 3:
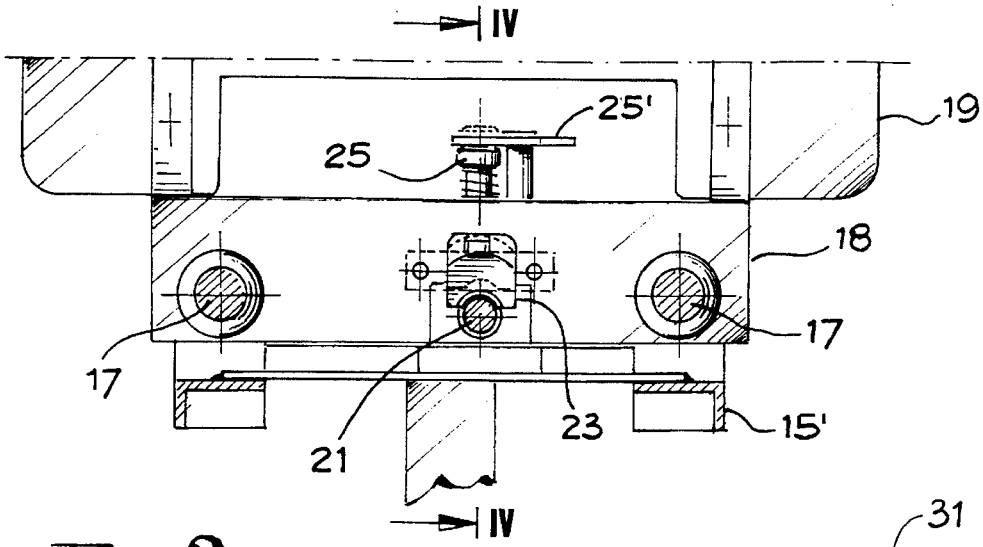
FIG. 3 shows a cross view according to the arrows III—III in FIG. 2.
Figure 4:
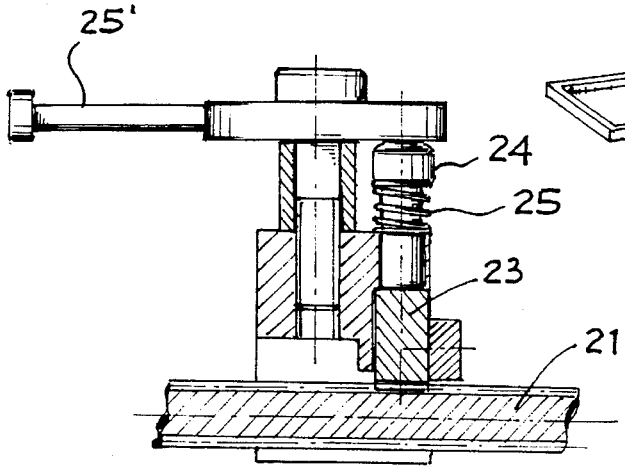
FIG. 4 shows a side view according to the arrows IV—IV in FIG. 3.

On the support 16, parallelly to the guide bars 17, there is a rotating screw 21 controlled by a gearmotor 16 by means, for instance, of a driving belt 22. The rotating screw 21 determines the movement of the carriage 18 from the back to the front. To this end, the carriage 18—see FIGS. 3 and 4—comes with at least a split nut 23 destined to interact with the rotating screw 21. This split nut 23 can be moved from an approaching and coupling with the rotating screw 21 to detaching and disconnecting position. The split nut 23 is supported by a rod 24 activated by a spring 25 which normally tends to move the split nut away from the screw. In the coupling position, the split nut 23 is kept close to the screw 21 by means of a stop lever 25' situated at the summet of the rod 24 and counterposing the action of the spring 25. Under this condition, the carriage 18 moves forward following the rotation of the control screw 21 for dispensing newspapers. When the stop lever 25' is moved away from the rod 24, the spring 25 causes the the split nut 23 to move away from the screw, so that the carnage 18 is released and can be moved manually in the backward position, i.e. the position in which the newspapers are reloaded on the mechanism via the front door. Once the newspapers have been loaded, the split nut is moved by means of the stop lever 25 in the position where it interacts with the screw 21.

At one end of the rotating screw 21, above the delivery opening 14, there is an expulsion cam 26 which is preferably conical with increasing diameter starting from the screw 21 to the end of the cam itself. This expulsion cam 26 has an helical groove 26' with one or more starting points to receive and convey one newspaper at a time to a chute 27 passing through the delivery opening 14 of the casing 11.

On one side of the expulsion cam 26 there is a photocell 28 to detect that a newspaper is present after the one dispensed and stop the gearmotor 16. Along the chute 27, or in the pick-up opening 14, there is a microswitch 29 which serves to inhibit operation of the coin slot when the mechanism is in operation for the time required to dispense a newspaper. Lastly, the casing 11 is designed to house a normally closed limit switch 30 to open the circuit on the gearmotor and inhibit the operation of the vending machine when there are any more newspaper copies on the carriage.

In practice, the insertion in the slot of the countervalue (in banknotes, coins or credit cards) of a newspaper causes activation of the mechanism which moves the carriage forward, the picking up of a copy of newspaper (the one ranking first at the front of the stack of newspapers) by the expulsion cam 26 and the conveyance of the newspaper to the delivery chute and the pick-up opening 14. The newspaper dispensed, passing through the chute 27 activates the microswitch 29 and disactivates operation of the coin slot until when the dispensing mechanism 15 is in operation and the next copy of newspaper does not reach the photocell 26 situated on one side of the expulsion cam. The gearmotor 16 then stops and prevents the carriage and thus the newspaper from moving forward. Only then it will be possible to activate the dispensing mechanism by inserting the countervalue of a newspaper into the relevant slot for dispensing the next copy of newspaper.

When the last copy of newspaper has been dispensed, the carriage 18 activates the limit switch 30 to disactivate the dispensing mechanism and turn on a light indicating that the newspapers are missing.

Figure 5:
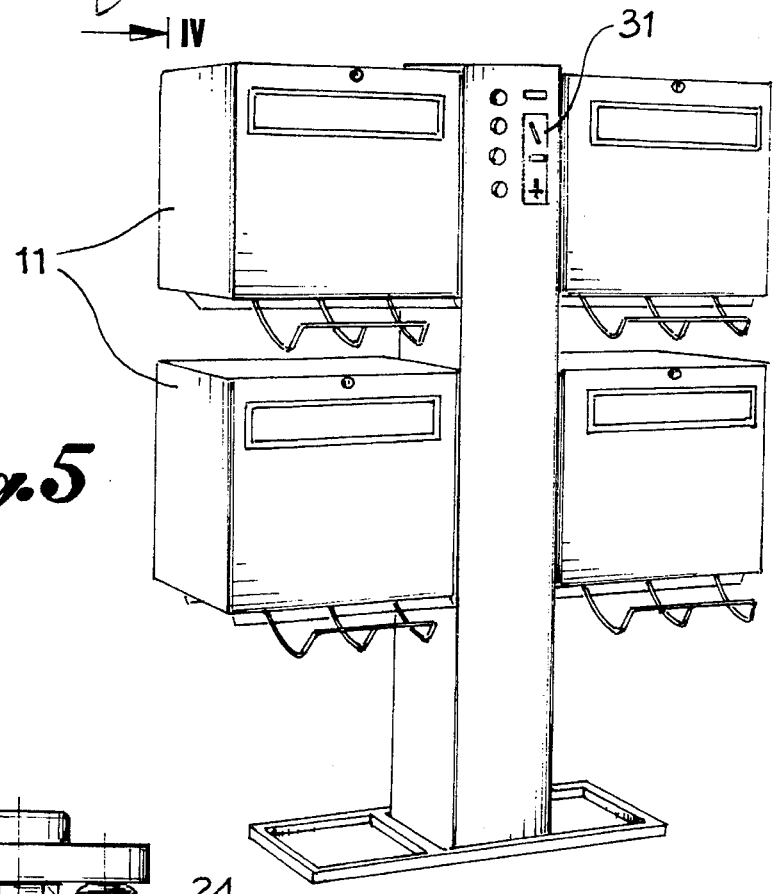
FIG. 5 shows the arrangement of more than one vending machine on a single support.

The automatic vending machine described above can be used and installed as a separate unit, but owing to the limited space it requires, it can be advantageously installed in series with other similar vending machines on the same supporting column, as shown in FIG. 5, on which it will be possible to install a central coin slot 31 and the means of selection and pick-up of the various items from each individual vending machine.

I claim:

1. An automatic vending machine for newspapers, magazines and the like, comprised of a casing (11) with at least a door (12) at the front, a bottom base (13) and a pick-up opening (14) in the bottom base adjacent to the front wall and in which a coin slot is provided to receive the countervalue of each newspaper or item to dispense and activate operation of the dispensing mechanism, characterized in that:

a support (15') resting on the internal bottom of the casing and supporting a pair of parallel side bars (17);

a carriage (18) sliding along these guide bars (17) backwards and forwards and destined to feed a series of newspapers or magazines standing sideways on said guide bars;

a rotating screw (21) arranged in parallel with said guide bars (17) and driven in rotation by an electric gearmotor (16);

at least a split nut (23) on board of said carriage (18) and interacting with said rotating screw (21) for progressive move of the carriage from its back to front position;

an expulsion cam (26) coupled and rotating with said screw (21) and destined to receive, every time, the copy of the newspaper (2) ranking first in the stack of newspapers moving with the carriage and to convey it onto a delivery chute to the pick-up opening (14) at the bottom of said casing (11);

the gearmotor (16) driving said screw (21) and said expulsion cam (23) coupled to it is activated when it receives an authorization signal from the prepayment slot and stopped when the newspaper drops into the pick-up opening and on arrival of the next copy of newspaper on the expulsion cam, being the expulsion cam and/or delivery chute associated with switching means to open the electric circuit on the motor unit to stop the carriage after expulsion of each newspaper.

2. An automatic vending machine according to claim 1, in which the guide bars (17) are held by said support (15') in an inclined position from the bottom to the top starting from the back of the casing up to the pick-up opening (14).

3. An automatic vending machine according to claim 1, in which the split nut (23) on board of the carriage (18) can be moved from a coupling position with the rotating screw (21) to a de-coupling position, causing in the coupling position the carriage (18) to move forwards from the back to the front, being the carriage free in the de-coupling position to move backwards.

4. An automatic vending machine according to claim 3, in which the split nut (23) is supported by a rod (24) activated by a spring (25) to normally maintain the split nut (23) in the de-coupling position, and in which a stop lever (25') interacts with said rod (24) and keeps the split nut in the coupling position.

5. An automatic vending machine according to claim 1, in which the expulsion cam (26) is in the shape of a conical element with an increasing diameter starting from the screw (21) to which it is coupled, with said cam having a helical groove (26') with one or more starting points destined to receive and convey a copy of newspaper at a time and send it to the delivery chute.

6. An automatic vending machine according to claim 1, in which on one side of the expulsion cam (26) there is a photocell (28) to detect the presence of a copy of newspaper following the one dispensed and stop the motor appliance, and in which along the chute and/or said pick-up opening a microswitch is provided to detect the passage of the copy of newspaper dispensed and inhibit operation of the slot when the dispensing device is in operation.

7. An automatic vending machine according to claim 2, in which on one side of the expulsion cam (26) there is a photocell (28) to detect the presence of a copy of newspaper following the one dispensed and stop the motor appliance, and in which along the chute and/or said pick-up opening a microswitch is provided to detect the passage of the copy of newspaper dispensed and inhibit operation of the slot when the dispensing device is in operation.

8. An automatic vending machine according to claim 3, in which on one side of the expulsion cam (26) there is a photocell (28) to detect the presence of a copy of newspaper following the one dispensed and stop the motor appliance, and in which along the chute and/or said pick-up opening a microswitch is provided to detect the passage of the copy of newspaper dispensed and inhibit operation of the slot when the dispensing device is in operation.

9. An automatic vending machine according to claim 4, in which on one side of the expulsion cam (26) there is a photocell (28) to detect the presence of a copy of newspaper following the one dispensed and stop the motor appliance, and in which along the chute and/or said pick-up opening a microswitch is provided to detect the passage of the copy of newspaper dispensed and inhibit operation of the slot when the dispensing device is in operation.

10. An automatic vending machine according to claim 5, in which on one side of the expulsion cam (26) there is a photocell (28) to detect the presence of a copy of newspaper following the one dispensed and stop the motor appliance, and in which along the chute and/or said pick-up opening a microswitch is provided to detect the passage of the copy of newspaper dispensed and inhibit operation of the slot when the dispensing device is in operation.

* * * * *